US007704103B1

(12) United States Patent
Rhein et al.

(10) Patent No.: US 7,704,103 B1
(45) Date of Patent: Apr. 27, 2010

(54) LOW PROFILE TERMINALS

(75) Inventors: David James Rhein, Memphis, MI (US); Jason Steven Ferraro, Malvern East (AU)

(73) Assignees: Tyco Electronics Corporation, Berwyn, PA (US); Tyco Electronics Lambda, Kingsgrove (AU)

( * ) Notice: Subject to any disclaimer, the term of this patent is extended or adjusted under 35 U.S.C. 154(b) by 0 days.

(21) Appl. No.: 12/364,362

(22) Filed: Feb. 2, 2009

(51) Int. Cl.
*H01R 13/40* (2006.01)

(52) U.S. Cl. ..... 439/752.5; 439/855; 439/860

(58) Field of Classification Search ..... 439/752.5, 439/876, 849, 851, 948, 845, 850, 860, 855
See application file for complete search history.

(56) References Cited

U.S. PATENT DOCUMENTS 5,624,273 A * 4/1997 Myer ..... 439/399
5,707,243 A * 1/1998 Endo et al. ..... 439/76.2
6,123,574 A * 9/2000 Matsuda et al. ..... 439/488

* cited by examiner

*Primary Examiner*—Neil Abrams
*Assistant Examiner*—Phuong Nguyen

(57) ABSTRACT

A terminal for mating with a blade contact includes a planar bottom extending between a front end and a rear end. A slot is formed in the planar bottom for receiving the blade contact, and the slot includes a front edge and a rear edge. Deflectable beams extend from the bottom across the slot for engaging the blade contact. At least one beam extends at least partially across the slot from the front edge and at least one beam extends at least partially across the slot from the rear edge. The beams are configured to engage opposite sides of the blade contact when the blade contact is mated with the terminal.

20 Claims, 5 Drawing Sheets

LOW PROFILE TERMINALS

BACKGROUND OF THE INVENTION

The subject matter herein relates generally to terminals, and more particularly, to low profile terminals for electronic modules.

These electronic control modules may comprise various electronic components. A wire harness or lead frame is used for electrically interconnecting the various components of the control module with other components of an electronic system utilizing the control module. The wire harness or lead frame may be provided in an housing or interconnecting module that is enclosed within the control module. Automobile systems such as a transmission system, braking system, airbag system and the like are examples of systems that utilize electronic modules to control and/or monitor the performance of the system.

In the example of the transmission control system, various components of the transmission control system, such as solenoids, thermistors, pressure switches, sensors, and the like, are interconnected by one or more interconnecting modules. Conventional control modules typically use one of two types of interconnecting modules, namely an overmolded leadframe or a wire harness. Both types of conventional interconnecting modules have disadvantages. For example, wire harnesses include many wires with terminals or connectors at the ends of the wires for connecting to contacts of the various components of the transmission system. The connections between the connectors and the components are made in place, typically be hand, once the components are assembled within the vehicle. When many connections are required, the task of connecting each of the terminals to the components is time intensive and costly. Additionally, space constraints make the assembly difficult. Furthermore, when assembled, the terminals of the wire harness extend from the component in a direction generally away from the component, which adds to the overall height of the assembly. Thus, space is required around the component to accommodate the connectors of the wire harness, which may be undesirable as space within an engine compartment, for example, is limited.

Transmission control modules that use overmolded leadframe type interconnecting modules for interconnecting the various components of the transmission control system have been implemented to address the space constraints typical of automotive applications, as overmolded leadframes typically have a low profile (e.g. additional height measured above the corresponding components). The overmolded leadframes include conductors in the form of copper traces that are routed within the interconnecting modules in a predetermined arrangement to mate with multiple, and potentially all, of the components of the transmission control system. The conductors have mating areas that mate with the contacts of the various components. The conductors are overmolded, forming an assembly that may be attached to one or more of the components to make simultaneous connection with various contacts of the components. Overmolded leadframes are not without disadvantages however. For example, there are often multiple steps of mold modification in order to properly orient each of the conductors for connection to the various contacts. For example, the leadframe is typically manufactured in multiple steps, where various conductors of the leadframe are initially connected to one another for stability during a first overmolding step. The conductors are separated from one another in another step so that the circuits do not short circuit. One or more overmolding steps are then performed to finalize the overmold. Because the overmolding process is complex, the overall cost to manufacture such overmolded leadframe interconnecting modules is high, especially as compared to a wire harness interconnecting module.

A further problem encountered with the use of overmolded leadframes is that the overmolded leadframes are designed specifically for mating with a particular combination of components of the transmission control module. Any change in the configuration of the components or the addition of other components would result in an entire redesign of the overmolded leadframe. Such redesigns are very costly in terms of retooling of the dies and molds needed to manufacture the overmolded leadframe interconnecting module. The molds and dies are specific to one particular application.

Accordingly, a need remains for interconnecting modules that may be manufactured in a cost effective way. Additionally, a need remains for electronic modules that have a low profile. A need remains for interconnecting modules that may be installed in an efficient manner.

BRIEF DESCRIPTION OF THE INVENTION

In one embodiment, a terminal for mating with a blade contact is provided that includes a planar bottom extending between a front end and a rear end. A slot is formed in the planar bottom for receiving the blade contact, and the slot includes a front edge and a rear edge. Deflectable beams extend from the bottom across the slot for engaging the blade contact. At least one beam extends at least partially across the slot from the front edge and at least one beam extends at least partially across the slot from the rear edge. The beams are configured to engage opposite sides of the blade contact when the blade contact is mated with the terminal.

Optionally, the beams may extend into the slot such that the slot has a generally M-shape when viewed from below the bottom of the terminal. A portion of the beams may be angled with respect to the bottom such that the beams are non-coplanar with the bottom. Optionally, the beams may extend to a mating portion, where the mating portion of each beam engages the blade contact when the blade contact is mated with the terminal. One of the beams may define a center beam and extend from the bottom front edge in a first direction, and two of the beams may define outer beams and extend from the bottom rear edge in a second direction generally opposite the first direction. The outer beams may flank the center beam on opposite sides of the center beam.

Optionally, the terminal may include opposed sides extending upward from the bottom. The sides may have arms extending therefrom, with the arms aligned with corresponding beams and with the arms blocking deflection of the beams beyond a predetermined limit. Optionally, the bottom may have a length and a width, and the terminal may have a height less than the length and the width of the bottom. The terminal may include a top opposite and spaced apart from the bottom, where the top includes an opening therethrough aligned with the slot. The blade contact may extend through the opening when the blade contact is mated with the terminal. The beams may be deflected through the opening when the blade contact is mated with the terminal. Optionally, the terminal may define a perimeter defining a height, width and length, where the blade contact is loaded through the slot in a direction corresponding to the height. The height may be less than the width and the length.

In another embodiment, an interconnecting module is provided that includes a housing having outer walls defining a cavity and inner walls defining a plurality of terminal chambers within the cavity. The housing includes a base and a plurality of apertures through the base. The apertures are aligned with and open at the terminal chambers. The apertures are configured to receive blade contacts therethrough. Terminals are received within corresponding terminal chambers. The terminals have a mating section configured to mate with the corresponding blade contact. The mating section has a planar bottom with a slot formed therein, where the slot is aligned with the aperture and is configured to receive the blade contact in a direction generally orthogonal to the planar bottom. The mating section has deflectable beams extending from the bottom across the slot in opposite directions, where the beams are configured to engage opposite sides of the blade contact.

DETAILED DESCRIPTION OF THE INVENTION

Figure 1:
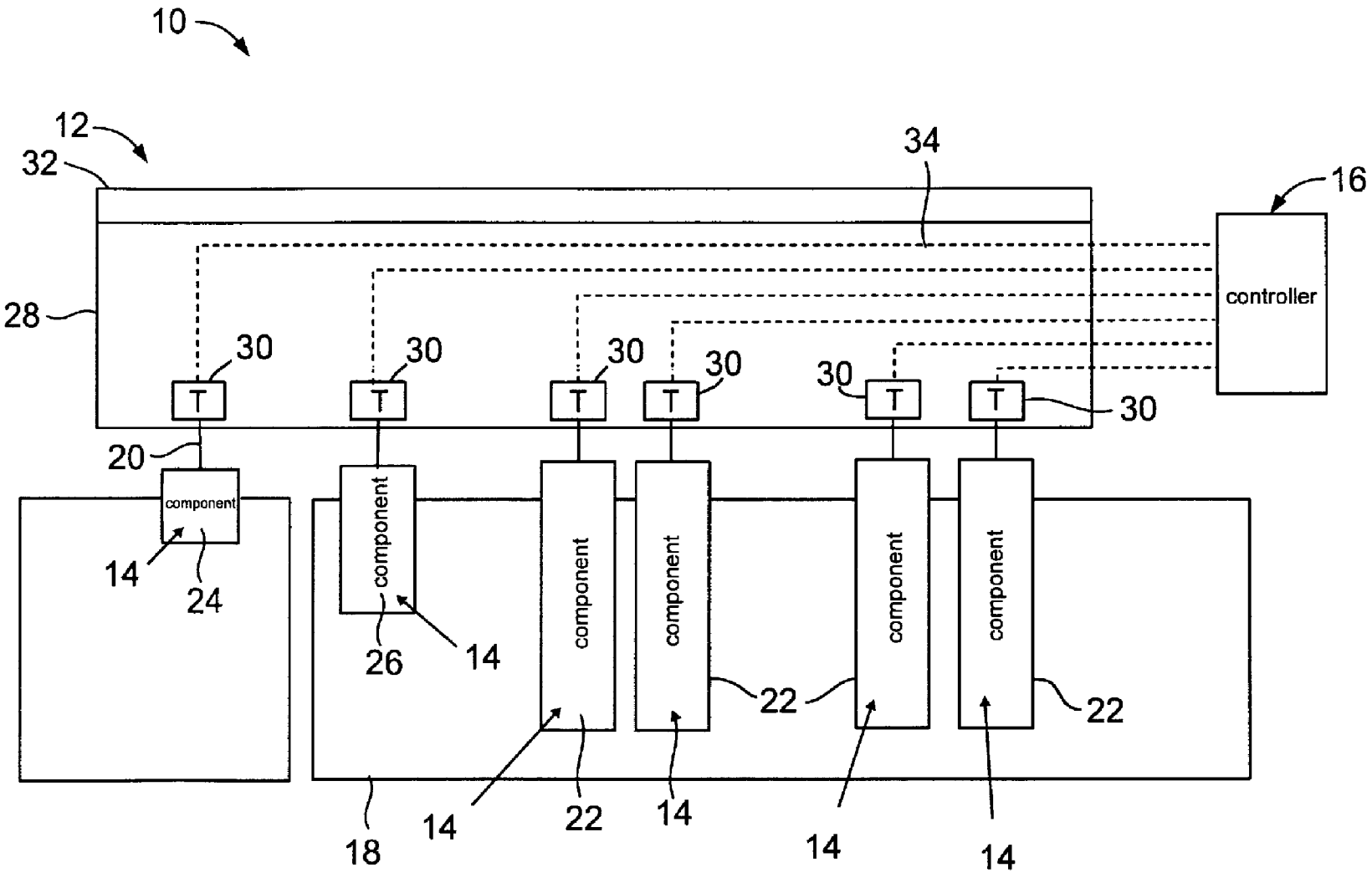
FIG. 1 is a schematic illustration of an exemplary electronic control module that utilizes an interconnecting module.

FIG. 1 is a schematic illustration of an exemplary electronic control module 10 that utilizes an interconnecting module 12 for interconnecting components 14 of the control module 10 with one another and/or with a controller 16 or other electronic component. In an exemplary embodiment, the electronic control module 10 is used in an automotive application. For example, the electronic control module 10 may be used in a transmission subsystem, braking subsystem, airbag subsystem and the like. While the illustrated embodiment of the electronic control module 10 constitutes a transmission control module, it is realized that the subject matter herein is applicable to other subsystems of an automotive application or may also be applicable to other applications such as industrial systems, computer applications, and other systems that utilize interconnecting modules 12 that connect to electrical components.

The components 14 are held by a base(s) 18 in a predetermined arrangement. Each of the components 14 includes at least one contact 20 extending therefrom. Optionally, each of the components 14 are arranged on one side of the base 18 and the contacts 20 all extend from the components 14 in a similar direction. The components 14 and contacts 20 define a mating interface for mating with the interconnecting module 12. Optionally, the contacts 20 may be substantially coplanar. Alternatively, the contacts 20 may be arranged on multiple planes for mating with the interconnecting module 12.

In an exemplary embodiment, more than one type of component 14 is provided within the electronic control module 10. For example, in the illustrated embodiment, the electronic control module 10 includes one or more solenoids 22, one or more thermistors 24, and one or more pressure switches 26. Other types of components 14 may be used with the transmission control system. Additionally, different types of components may be used within other types of control systems.

The interconnecting module 12 includes a housing 28 and a plurality of terminals 30 held within the housing 28. A cover 32 may enclose the terminals 30 within the housing 28. The terminals 30 are arranged for mating with the contacts 20 of the components 14. The housing 28 may be coupled to the base 18 and/or one or more of the components 14 such that the terminals 30 electrically connect with the contacts 20. The terminals 30 are electrically connected to the controller 16 or another electronic connector, system or module, such as by wires 34, represented schematically in FIG. 1. Optionally, the wires 34 may be routed within the housing 28 generally co-planar with the terminals 30. The wires 34 may be routed to more than one location and/or controller 16.

Figure 2:
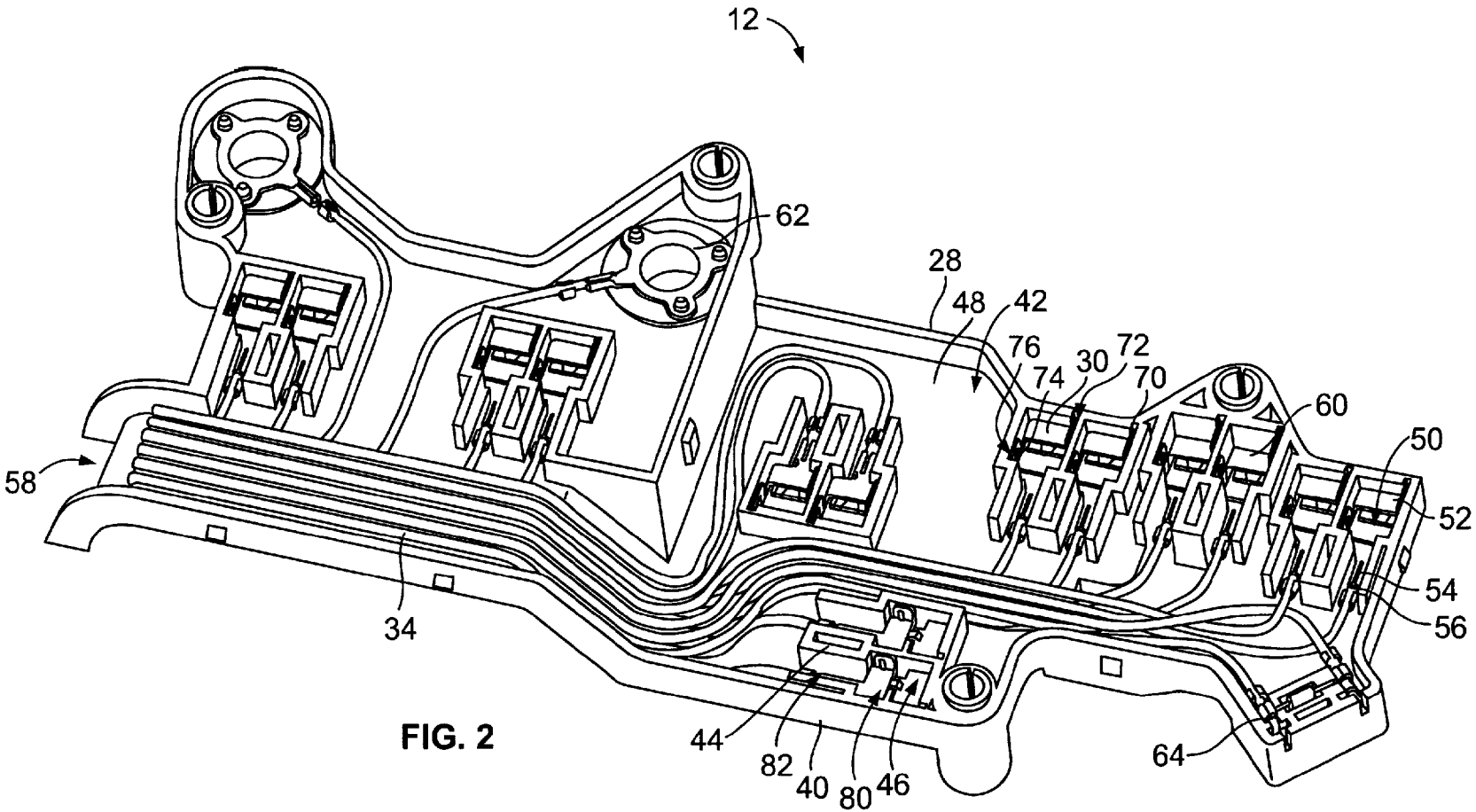
FIG. 2 is a top perspective view of an exemplary interconnecting module for the control module shown in FIG. 1 with a cover of the interconnecting module removed.

FIG. 2 is a top perspective view of the interconnecting module 12 for the control module 10 (shown in FIG. 1) with the cover 32 (shown in FIG. 1) of the interconnecting module 12 removed. The housing 28 includes outer walls 40 defining a cavity 42 and inner walls 44 defining a plurality of terminal chambers 46 within the cavity 42. The housing 28 includes a base 48 and a plurality of apertures 50 through the base 48. The apertures 50 are aligned with and open at the terminal chambers 46. The apertures 50 are configured to receive corresponding contacts 20 (shown in FIG. 1) therethrough.

As will be described in further detail below, the contacts 20 extending into the terminals chambers 46 may constitute blade contacts, which are generally planar rectangularly shaped contacts. The contacts 20 extending into the terminal chambers 46 may be contacts of a solenoid or other component.

The terminals 30 are received within corresponding terminal chambers 46. The terminals 30 have a mating section 52 configured to mate with the corresponding contact 20 and a wire termination section 54 extending from the mating section 52. Ends 56 of corresponding wires 34 are terminated to the terminals 30 at the wire termination section 54. Optionally, the wire termination section 54 may include a wire barrel and the terminal 30 is terminated to the wire 34 by a crimp connection. Other types of connections are possible in alternative embodiments, such as solder connections, insulation displacement connections, and the like. The wires 34 are routed through the cavity 42 from the respective terminals 30 to a port 58 through one or more of the outer walls 40. The wires 34 enter/exit the housing 28 through the port 58 and may be connected to the controller 16 (shown in FIG. 1) or another electronic connector or module or other electronic component external to the interconnecting module 12.

The terminals 30 are arranged in a predetermined arrangement for mating with the contacts 20 of the various components 14 (shown in FIG. 1). The arrangement of the terminals 30 may be controlled based on the location of the various components 14. Changes in the design of the control module 10, such as by repositioning of the components 14 or addition or removal of certain components 14 may be accommodated for by changes in the design of the housing 28. For example, the mold for the housing 28 may be retooled to change the location of one or more of the terminals 30. The terminals 30 may be mounted within the housing 28 without major modification of the terminals 30 or the wires 34, but rather, mere repositioning of the terminals 30 and rerouting of the wires 34. Such modification is easier and less costly to accomplish as compared to overmolded leadframe designs.

In the illustrated embodiment, three types of terminals 30 are illustrated for mating with contacts 20 of three different types of components 14. Low profile terminals 60 are provided for mating with contacts 20 of a solenoid. Pressure switch ring terminals 62 are provided for mating with contacts 20 of a pressure sensor component. Thermistor terminals 64 are provided for mating with contacts 20 of a thermistor. The contacts 20 that the low profile terminals 60, ring terminals 62 and the terminals 64 mate to may be of any conventional type, such as blade contacts, pin contacts and the like. The terminals 60 are discussed in more detail below. The structure and functions of the terminals 60 may be incorporated into other types of terminals for mating with contacts 20 of other types of components other than solenoids. The terminals 60 may replace the ring terminals 62 and/or the terminals 64.

In an exemplary embodiment, the terminals 60 are arranged in pairs for mating with contacts 20 of pairs of solenoids. In the illustrated embodiment, seven pairs of terminals 60 are provided and held within the housing 28. More or less pairs may be provided in alternative embodiments. The number of pairs of terminals 60 depends on and corresponds with an equivalent number of solenoids within the control module 10. The terminals 60 are arranged within the housing 28 such that the terminals 60 may be substantially simultaneously mated with the contacts 20 of more than one pair of solenoids. Optionally, the terminals 60 may be substantially simultaneously mated with the contacts 20 of each of the solenoids. For example, when the contacts 20 of the solenoids are arranged on more than one plane, the terminals 60 are similarly positioned on more than one plane. However, in some embodiments, each of the terminals 60 may be substantially coplanar with one another.

In an exemplary embodiment, the terminals 60 include keying features 70 and the housing 28 includes corresponding keying features 72 that mate with the keying features 70 to properly orient the terminals 60 within the terminal chambers 46. The keying feature 70 may constitute a tab extending outward from the terminal 60. The keying feature 72 may constitute a channel formed in one of the inner walls 44 that receives the keying feature 70. The keying features 70, 72 are not limited to the tabs and channels described herein, and other types of keying features may be used in alternative embodiments to properly orient and/or align the terminals 60 with respect to the terminal chambers 46.

The terminals 60 include terminal retention features 74 and the housing 28 includes corresponding locking features 76 that receive the terminal retention features 74 to secure the terminals 60 within the terminal chambers 46. The terminal retention features 74 may constitute fingers extending outward from the terminal 60. The locking features 76 may constitute windows formed in the inner walls 44 that receives the terminal retention features 74. The retention and locking features 74, 76 are not limited to the fingers and windows described herein, and other types of features may be used in alternative embodiments to properly secure the terminals 60 with respect to the terminal chambers 46.

In an exemplary embodiment, each terminal chamber 46 includes a wide portion 80 and a narrow portion 82. The inner walls 44 define the different portions 80, 82. The wide portion 80 receives the mating section 52. The narrow portion 82 receives the wire termination section 54 and the wire 34. The wide and narrow portions 80, 82 of the terminals chamber 46 may receive a portion(s) of the terminal 60 by a friction fit to snuggly hold the terminal 60 within the terminal chamber 46. Both the wide and narrow portions 80, 82 may be open at the tops thereof opposite the base 48 to receive the terminal 60 through the open top. The terminal chamber 46 may have a height measured between the base 48 and the tops of the inner walls 44 that is similar to a height of the terminal 60. Optionally, the height of the inner walls 44 may be slightly taller than the height of the terminal 60. The height of the inner walls 44 may be substantially similar to a diameter of the wires 34.

Figure 3:
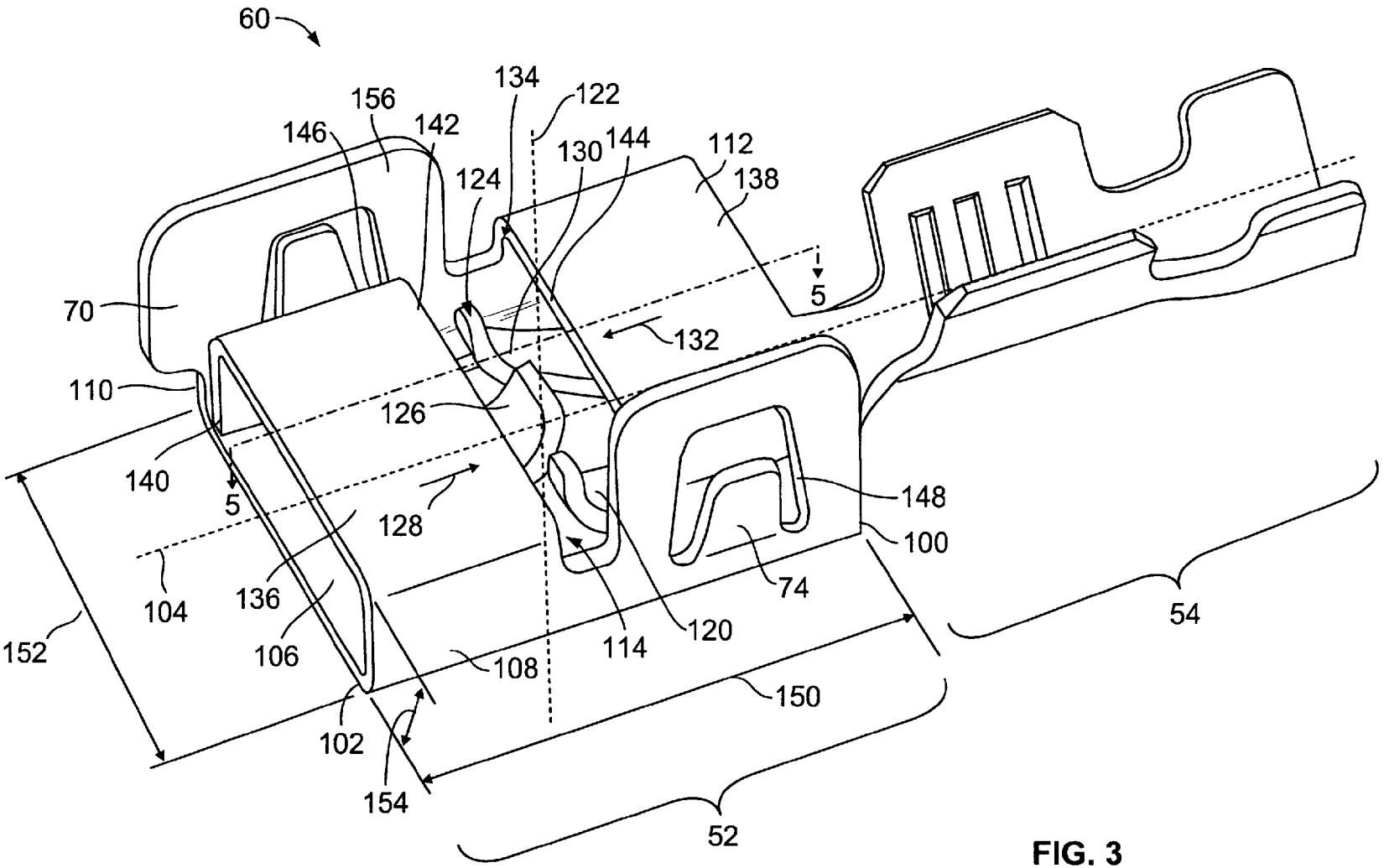
FIG. 3 is a perspective view of an exemplary terminal for use with the interconnecting module shown in FIG. 2.

FIG. 3 is a perspective view of one of the terminals 60 for use with the interconnecting module 12 (shown in FIG. 2). The terminal 60 includes the mating section 52 and the wire terminating section 54 extending from a rear end 100 of the mating section 52. The mating section 52 has a front end 102 generally opposite the rear end 100. A longitudinal axis 104 extends between the front end 102 and the rear end 100. A generally planar bottom 106 extends along the longitudinal axis 104 between the front end 102 and the rear end 100. The terminal 60 includes opposed sides 108, 110 that extend from the bottom 106. The sides 108, 110 extend to a top 112 generally opposite the bottom 106.

The terminal 60 includes a slot 114 formed in the bottom for receiving the contact 20 (shown in FIG. 1). The slot 114 has a front edge 164 (shown in FIG. 4) and a rear edge 166 (shown in FIG. 4).

A plurality of deflectable beams 120 extend from the bottom 106 across the slot 114 for engaging the contact 20. In particular, the contact 20 is received through the slot 114 in the bottom 106 to engage the beams 120. The contact 20 is received along a mating axis 122 that is generally perpendicular to the longitudinal axis 104. In an exemplary embodiment, the beams 120 extend across the slot 114 in multiple directions such that the beams 120 cross the mating axis 122 from more than one direction. The beams 120 are thus configured to engage more than one side of the contact 20 (e.g. opposite planar sides of the contact 20). Optionally, the beams 120 extend at least halfway across the slot 114 to ensure that the beams 120 will engage the contact 20 on both sides when the contact 20 is mated with the terminal 60. At least a portion of the beams 120 are angled upwardly with respect to the bottom 106 toward the top 112 such that the beams 120 are non-coplanar with the bottom 106. The beams 120 extend to a mating portion 124. The mating portion 124 of each beam 120 engages the contact 20 when the terminal 60 is mated with the contact 20. During mating with the contact 20, the beams 120 may be deflected upward and/or outward away from the contact 20 by the contact 20.

In an exemplary embodiment, one of the beams 120 defines a center beam 126 and extends the front edge 164 of the slot 114 in a first direction indicated by the arrow 128. Two of the beams 120 define outer beams 130 and extend from the rear edge 166 of the slot 114 in a second direction indicated by the arrow 132. The second direction 132 is generally opposite to the first direction 128. The outer beams 130 flank the center beam 126 on opposite sides of the center beam 126. Optionally, the center beam 126 may be larger than the outer beams 130 (e.g. wider and/or longer). The center beam 126 engages one side of the contact 20 and the outer beams 130 engage the opposite side of the contact 20. Optionally, the center beam 126 imparts a substantially equal and opposite force on the contact 20 as compared to the outer beams 130 together. Optionally, the outer beams 130 impart substantially similar forces on the contact 20 so that pivoting or twisting between the contact 20 and the terminal 60 is reduced or eliminated. The beams 126, 130 are located to allow the contact 20 to be inserted therebetween along a mating axis and to hold the contact 20. The beams 126, 130 are located to allow strong mechanical and electrical connection with the contact 20.

The top 112 of the terminal 60 is spaced apart from and generally parallel to the bottom 106. The top 112 includes an opening 134 therethrough aligned with the slot 114. The contact 20 may extend through the opening 134 when the terminal 60 is mated with the contact 20. Optionally, the beams 120 may also extend through the opening 134 prior to and/or after the terminal 60 being mated with the contact 20.

In an exemplary embodiment, the terminal 60 includes a front arm 136 and a rear arm 138 extending from one or both of the sides 108, 110. The opening 134 may be arranged between the arms 136, 138. The arms 136 may define the top 112 and a distal end 140 of each arm 136, 138 may be folded back toward the bottom 106 along the opposite side 108, 110 from which the arm 136, 138 extends. The arms 136, 138 may be aligned in front of or behind corresponding beams 120 and extend over a portion of the beams 120. For example, the front arm 136 may extend over the center beam 126 and the rear arm 138 may extend over the outer beams 130. During mating of the terminal 60 with the contact 20, the beams 120 may be deflected outward and/or upward. The arms 136, 138 may block deflection of the beams 126, 130, respectively, beyond a predetermined limit. For example, the beams 126, 130 may engage edges 142, 144 of the arms 136, 138, respectively. As such, the arms 136, 138 provide overstress protection by stopping deflection of the beams 120 beyond a predetermined limit, such as prior to plastic deformation of the beams 120.

The terminal retention features 74 extend outward from the sides 108, 110. The terminal retention features 74 are configured to engage the housing 28 (shown in FIG. 2) to hold the terminal 60 in place with respect to the housing 28. The arms 136, 138 are aligned with the terminal retention features 74. The arms 136, 138 may block deflection of the terminal retention features 74 beyond a predetermined limit. For example, the terminal retention features 74 may engage edges 146, 148 of the arms 136, 138, respectively. As such, the arms 136, 138 keep the terminal retention features 74 from angling inward. The arms 136, 138 may provide overstress protection by stopping inward deflection of the terminal retention features 74 beyond a predetermined limit, such as prior to plastic deformation of the terminal retention features 74.

The terminal 60 defines a low profile terminal. The mating section 52 and the wire termination section 54 are generally coplanar and extend along the longitudinal axis 104. The bottom 106 and the top 112 of the terminal 60 have a length 150 and a width 152. Alternatively, the lengths and the widths of the bottom 106 and top 112 may be different. The terminal sides 108, 110 have a height 154. The sides 108, 110 may have projections 156 that extend upward from the sides 108, 110, wherein the sides 108, 110 are taller at the projections 156 than other portions thereof. In an exemplary embodiment, the height 154 of the terminal 60 is less than the length 150 or the width 152. Optionally, the length 150 may be approximately three or four times the height 154. Optionally, the width may be approximately three or four times the height 154. The terminal 60 has a perimeter defined by the height 154, width 152 and length 150. The contact 20 is loaded through the slot 114 in a direction along the mating axis 122, which corresponds to the direction defining the height 154.

Figure 4:
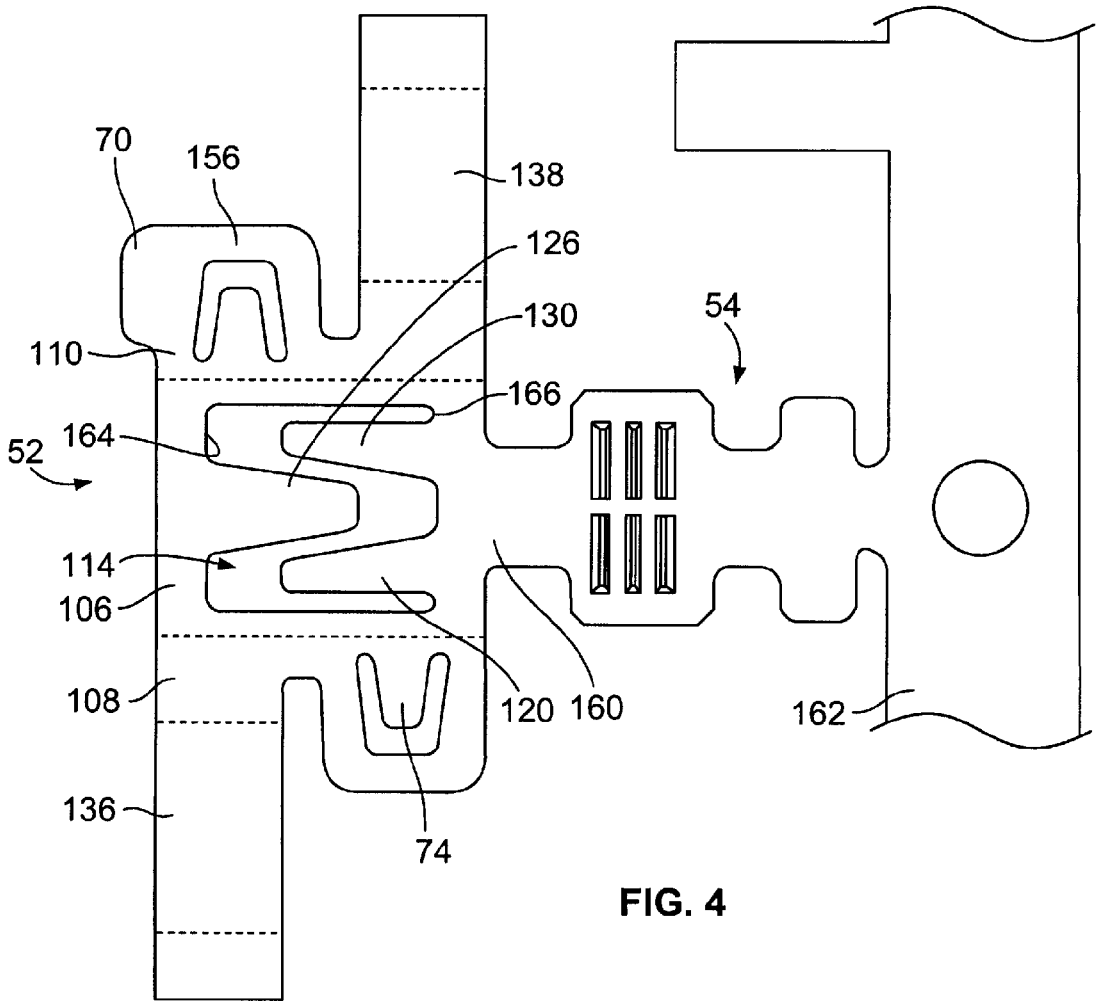
FIG. 4 illustrates an exemplary terminal blank that may be used to form the terminal shown in FIG. 3.

FIG. 4 illustrates an exemplary terminal blank 160 that may be used to form the terminal 60 (shown in FIG. 3). The blank 160 is stamped from a sheet of stock material. After stamping, the blank 160 is formed into the shape of the terminal 60. The blank 160 may be connected to a carrier strip 162 at the end of the wire termination section 54. After forming, the terminal 60 may be severed from the carrier strip 162.

The main part of the mating section 52 is the bottom 106. The sides 108, 110 extend from the bottom 106. The arms 136, 138 and the projections 156 extend from the sides 108, 110. One of the projections 156 is formed with the keying feature 70. Both sides 108, 110 and/or projections 156 include the terminal retention features 74.

The bottom 106 includes the slot 114 formed therethrough. In an exemplary embodiment, the slot 114 has an M-shape. When viewed from above or below the terminal 60, the slot 114 is formed around and/or defines the beams 120. The slot 114 includes the front edge 164 and the rear edge 166. The center beam 126 extends from the front edge 164 and the outer beams 130 extend from the rear edge 166. The outer beams 130 overlap the center beam 126 beyond the midpoint of the slot 114 between the front and rear edges 164, 166.

Figure 5:
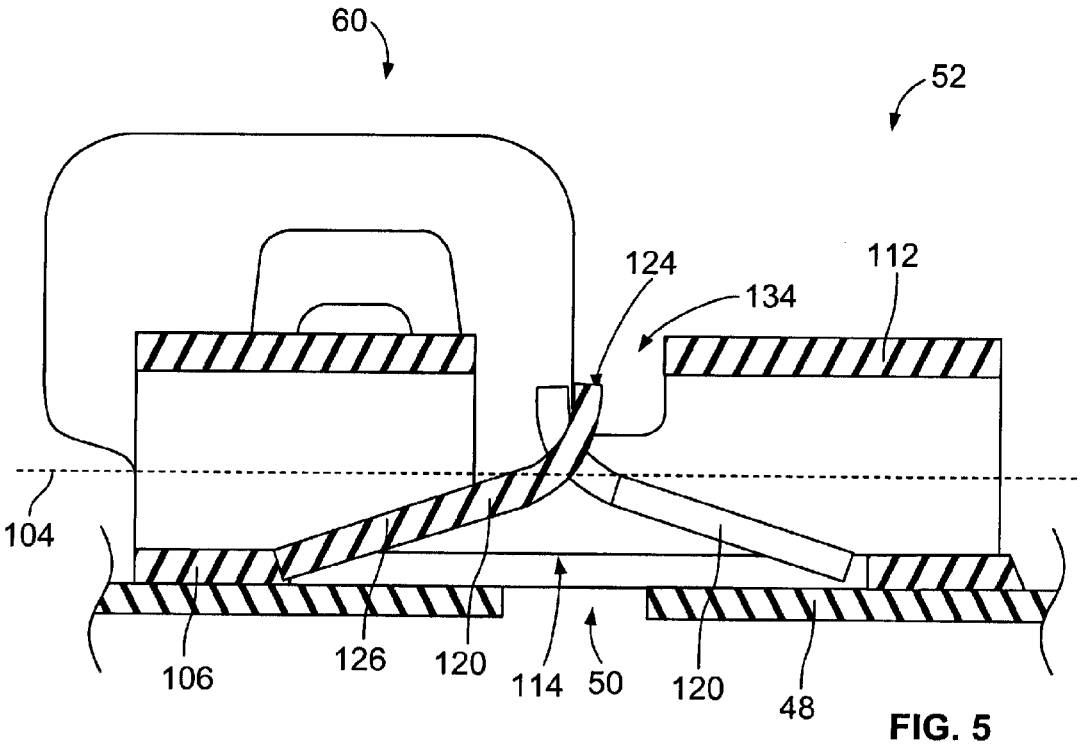
FIG. 5 is a cross-sectional view of the terminal shown in FIG. 3.

FIG. 5 is a cross-sectional view of the terminal 60 illustrating the mating section 52 but not the wire termination section 54 (shown in FIGS. 2 and 4). The terminal 60 is sectioned along the longitudinal axis 104 and the center beam 126 (shown by line 5-5 in FIG. 3). FIG. 5 also illustrates a portion of the housing 28 (shown in FIG. 1) of the interconnecting module 12 (shown in FIG. 1), namely the base 48. The terminal 60 is positioned with respect to the base 48 such that the slot 114 is aligned with the aperture 50 in the base 48. The aperture 50 may be smaller than the slot 114 and may be substantially centered with respect to the slot 114. The beams 120 are aligned with the aperture 50 such that the contact 20 (shown in FIG. 1) may extend through the aperture 50 and through the slot 114 to engage the beams 120.

During the forming operation of the terminal 60, the beams 120 may be bent or angled upward out of the plane defined by the bottom 106. In an exemplary embodiment, the mating portions 124 are bent or curved upward and/or outward. The curved part of the mating portions 124 are configured to engage the contact 20 (shown in FIG. 1) during mating of the terminal 60 with the contact 20. Prior to mating, the mating portions 124 may be approximately aligned with the opening 134 in the top 112. Once mated, the beams 120 may be deflected outward such that at least a portion of the mating portions 124 may extend through the opening 134.

Figure 6:
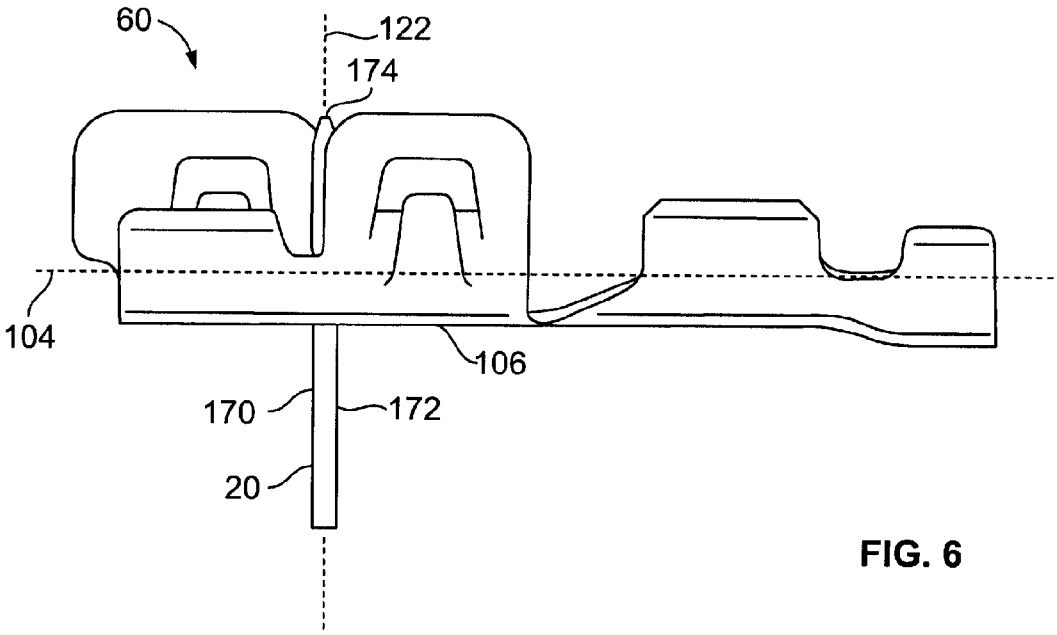
FIG. 6 is a side view of the terminal shown in FIG. 3 with a blade contact mated thereto.

FIG. 6 is a side view of the terminal 60 with the contact 20 mated thereto. In the illustrated embodiment, the contact 20 is a blade contact having opposed first and second planar sides 170, 172. The contact 20 extends to a tip 174. The contact 20 generally extends along the mating axis 122. The mating axis 122 is substantially perpendicular to the longitudinal axis 104 of the terminal 60. During mating, the terminal 60 is configured to mate with the blade contact 20 such that the blade contact 20 is oriented generally orthogonal with respect to the planar bottom 106. The overall height of the terminal 60, taken along the mating axis 122 is substantially less than the overall length of the terminal 60, taken along the longitudinal axis 104. Additionally, the profile of the terminal 60, particularly the height of the terminal 60, does not extend a considerable amount, if at all, beyond the tip 174 of the contact 20.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A terminal for mating with a blade contact, the terminal comprising:

a planar bottom extending between a front end and a rear end, a slot formed in the planar bottom for receiving the blade contact, the slot having a front edge and a rear edge;

a top opposite and spaced apart from the bottom, the top includes an opening therethrough aligned with the slot, the blade contact extends through the opening when the blade contact is mated with the terminal; and deflectable beams extending from the bottom across the slot for engaging the blade contact, at least one beam extending at least partially across the slot from the front edge and at least one beam extending at least partially across the slot from the rear edge, the beams being configured to engage opposite sides of the blade contact when the blade contact is mated with the terminal.

2. The terminal of claim 1, wherein the beams extend into the slot such that the slot has a generally M-shape when viewed from below the bottom of the terminal.

3. The terminal of claim 1, wherein the terminal is configured to receive the blade contact through the slot such that the planar bottom is oriented generally perpendicular with respect to the blade contact.

4. The terminal of claim 1, wherein a portion of the beams are angled with respect to the bottom such that the beams are non-coplanar with the bottom.

5. The terminal of claim 1, wherein the beams extend to a mating portion, the mating portion of each beam engages the blade contact when the blade contact is mated with the terminal.

6. The terminal of claim 1, wherein the beams are deflected outward away from the blade contact when the blade contact is mated with the terminal.

7. The terminal of claim 1, wherein one of the beams defines a center beam and extends from the bottom front edge in a first direction, two of the beams define outer beams and extend from the bottom rear edge in a second direction generally opposite the first direction, the outer beams flank the center beam on opposite sides of the center beam.

8. The terminal of claim 1, wherein the terminal includes opposed sides extending upward from the bottom, the sides have arms extending therefrom, the arms are aligned with corresponding beams, the arms block deflection of the beams beyond a predetermined limit.

9. The terminal of claim 1, wherein the bottom has a length and a width, the terminal has a height less than the length and the width of the bottom.

10. The terminal of claim 1, wherein the beams are deflected through the opening when the terminal is mated with the blade contact.

11. The terminal of claim 1, wherein the terminal defines a perimeter defining a height, width and length, the blade contact is loaded through the slot in a direction corresponding to the height, the height being less than the width and the length.

12. An interconnecting module comprising:

a housing having outer walls defining a cavity and inner walls defining at least one terminal chamber within the cavity, the housing includes a base and at least one aperture through the base, the at least one aperture being aligned with and open at a corresponding terminal chamber, the at least one aperture being configured to receive a blade contact therethrough; and at least one terminal received within a corresponding terminal chamber, each terminal having a mating section configured to mate with the corresponding blade contact, the mating section having a planar bottom with a slot formed therein, the slot being aligned with the corresponding aperture and being configured to receive the blade contact in a direction generally perpendicular to the planar bottom, the mating section having a top opposite and spaced apart from the bottom, the top includes an opening therethrough aligned with the slot, the blade contact extends through the opening when the blade contact is mated with the terminal, and the mating section having deflectable beams extending from the bottom across the slot in opposite directions, the beams being configured to engage opposite sides of the blade contact.

13. The interconnecting module of claim 12, wherein each terminal has a wire termination section extending from the mating section, the wire termination section being terminated to an end of a wire routed through the cavity.

14. The interconnecting module of claim 12, wherein each slot includes a front edge and a rear edge, at least one beam extends from the bottom at the front edge and at least one beam extends from the bottom at the rear edge.

15. The interconnecting module of claim 12, wherein the terminal includes opposed sides extending upward from the bottom, the sides have arms extending therefrom, the arms are aligned with corresponding beams, the arms block deflection of the beams beyond a predetermined limit.

16. The interconnecting module of claim 12, wherein each terminal includes a keying feature, the housing includes a corresponding keying feature that cooperates with the keying feature of the terminal to orient the terminal within the terminal chamber.

17. The interconnecting module of claim 12, wherein each terminal includes opposed sides extending upward from the bottom, the sides have terminal retention features that extend outward therefrom, the terminal retention features engage the housing to hold the terminal within the corresponding terminal cavity.

18. The interconnecting module of claim 17, wherein the sides have arms extending therefrom, the arms are aligned with corresponding terminal retention features, the arms block deflection of the terminal retention features beyond a predetermined limit.

19. A terminal for mating with a blade contact, the terminal comprising:

a planar bottom extending between a front end and a rear end, a slot formed in the planar bottom for receiving the blade contact, the slot having a front edge and a rear edge;

deflectable beams extending from the bottom across the slot for engaging the blade contact, each beam extending to a tip, at least one beam extending at least partially across the slot from the front edge and at least one beam extending at least partially across the slot from the rear edge, the beams being configured to engage opposite sides of the blade contact when the blade contact is mated with the terminal; and opposed sides extending upward from the bottom to a top in a vicinity of the deflectable beams, the sides extending from the bottom in a common direction as the deflectable beams, wherein the terminal has a height measured from the planar bottom to the taller of the tops of the sides or the tips of the beams.

20. The terminal of claim 19, wherein the terminal includes a top opposite and spaced apart from the bottom, the top includes an opening therethrough aligned with the slot, the blade contact extends through the opening when the blade contact is mated with the terminal.

* * * * *